US005260178A

United States Patent [19]

Harada et al.

[11] Patent Number: 5,260,178

[45] Date of Patent: Nov. 9, 1993

[54] SILVER HALIDE PHOTOGRAPHIC LIGHT-SENSITIVE MATERIAL

[75] Inventors: Toru Harada; Ichizo Toya, both of Kanagawa, Japan

[73] Assignee: Fuji Photo Film Co., Ltd., Kanagawa, Japan

[21] Appl. No.: 974,344

[22] Filed: Nov. 10, 1992

Related U.S. Application Data

[63] Continuation of Ser. No. 646,892, Jan. 28, 1991, abandoned.

[30] Foreign Application Priority Data

Jan. 31, 1990 [JP] Japan ..... 2-21125

[51] Int. Cl.[5] ..... G03C 1/20

[52] U.S. Cl. ..... 430/508; 430/584; 430/944

[58] Field of Search ..... 430/584, 944, 508

[56] References Cited

U.S. PATENT DOCUMENTS

| | | | |
|---|---|---|---|
| 4,839,265 | 6/1989 | Ohno et al. | 430/581 |
| 5,013,642 | 5/1991 | Muenter et al. | 430/944 |
| 5,028,516 | 7/1991 | Mukunoki et al. | 430/944 |
| 5,061,618 | 10/1991 | Parton et al. | 430/584 |
| 5,063,146 | 11/1991 | Inagaki et al. | 430/944 |

*Primary Examiner*—Janet C. Baxter

*Attorney, Agent, or Firm*—Sughrue, Mion, Zinn, Macpeak & Seas

[57] ABSTRACT

A silver halide photographic light-sensitive material which contains a tricarbocyanine dye having at least two acidic groups in such a condition that said dye may show its absorption maximum at a wavelength shifted to the longer wavelength direction by at least 50 nm, compared with that of the absorption maximum in an aqueous solution, and that within the range of 900 nm to 1,500 nm, whereby facilitating the detection of the position of said light-sensitive material by means of an infrared sensor in the photographic processing with an automatic developing machine.

7 Claims, 1 Drawing Sheet

SILVER HALIDE PHOTOGRAPHIC LIGHT-SENSITIVE MATERIAL

This is a continuation of application Ser. No. 07/646,892 filed Jan. 28, 1991, now abandoned.

FIELD OF THE INVENTION

This invention relates to a silver halide photographic light-sensitive material and, more particularly, to an art of facilitating the detection of the position of a black-and-white silver halide photographic light-sensitive material upon processing with an automatic developing machine (abbreviated as an auto-developing machine).

BACKGROUND OF THE INVENTION

In recent years the need for a rapid processing of light-sensitive materials has been increased. With respect to light-sensitive materials utilizing X-rays, in particular, the system of completing the photographic processing in 45 seconds has begun to prevail. In addition, the need for diminution in replenishing amounts of processing solutions has also grown. Under these circumstances, the tendency to reduce the silver coverage has become much more pronounced. However, the reduction in silver coverage causes a decrease in the rate of screened rays of infrared sensors installed in a conveyance system including an auto-developing machine, and thereby it becomes impossible to detect the position a light-sensitive material takes up, which is responsible for defective conveyance.

A method of reforming the poor condition of detection by the use of certain infrared absorbing dyes is disclosed in JP-A-62-299959 (The term "JP-A" as used herein means an "unexamined published Japanese patent application"). In using such dyes, however, it is necessary to make the dyes adsorb to silver halide grains, which imposes a load on processing steps (especially on the fixing step) and complicates the handling upon coating. Moreover, those dyes themselves absorb light in the visible region, and this absorption comes into question with respect to black-and-white light-sensitive materials which afford a silver image as the object of observation. On the other hand, JP-A-63-131135 discloses another method for improving the defective detection, in which light scattering grains such as silver halide grains are utilized. The screening effect of such grains upon an infrared sensor is small because this method takes advantage of their refractive index alone and, disadvantageously in the case of silver halide grains, a processing load is imposed on a fixer. Therefore, the situation becomes very serious in the case where replenishers are decreased in quantity and a rapid processing is carried out.

SUMMARY OF THE INVENTION

An object of this invention is to provide a silver halide photographic light-sensitive material which has a reduced silver coverage and an aptitude for a rapid processing system of the kind which uses reduced quantities of replenishers, and is designed so as to rid a film detecting apparatus of an undetectable situation without exerting any influences upon photographic characteristics.

The above-described object is attained with a silver halide photographic light-sensitive material which contains a tricarbocyanine dye having at least two acidic groups (e.g., sulfonic acid group, carboxylic acid group)

wherein the dye may show its absorption maximum at a wavelength shifted to the longer wavelength direction by at least 50 nm, compared with that of the absorption maximum in an aqueous solution, and the wavelength of the dye is within the range of 900 nm to 1,500 nm.

Figure 1:
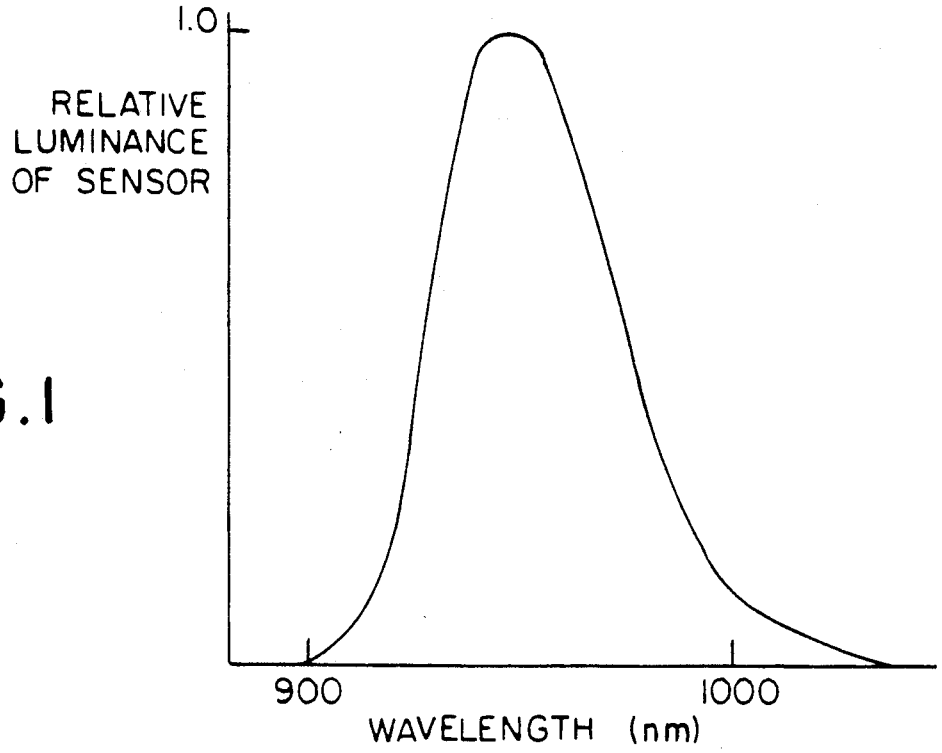
FIG. 1 and FIG. 2 show spectral sensitivity characteristics of an infrared-ray emission element and an infrared-ray reception element, respectively, which are fitted to a film insertion inlet of the auto-developing machine used in Example 1.
Figure 2:
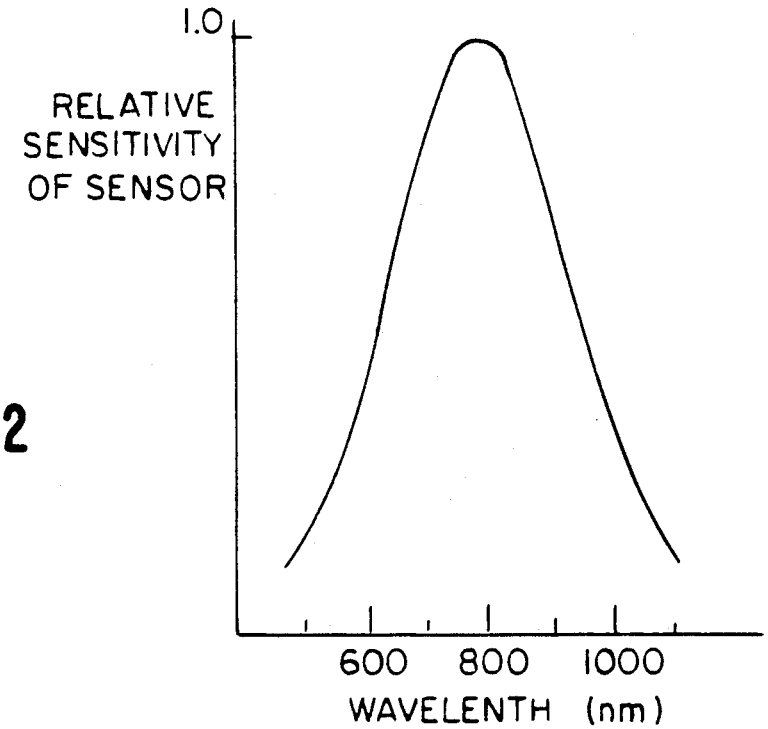

The numbers on the abscissa in both figures indicate the wavelength. The ordinate in FIG. 1 represents the relative luminance of the sensor and the ordinate in FIG. 2 represents the relative sensitivity of the sensor.

DETAILED DESCRIPTION OF THE INVENTION

In order to achieve the condition that, when contained in a photographic light-sensitive material, a tricarbocyanine dye having at least two acidic groups shows its absorption maximum at a wavelength shifted to the longer wavelength direction by at least 50 nm, compared with that of the absorption maximum in an aqueous solution, and the absorption maxima of the dye is within the range of 900 nm to 1,500 nm, there can be employed some methods, such as (1) the dye is made to adsorb to light-insensitive silver halide grains, (2) the dye is dissolved in a high boiling solvent, and dispersed in the form of emulsion, (3) the dye is dispersed in the form of solid fine particles, (4) the dye is made to assume the form of aggregate, and so on. Among these methods, it is preferred in particular to use the aggregate of a water-soluble dye, because the aggregate has an advantage in being added in the form of aqueous solution from the viewpoint of facility in production. Dyes apt for formation of aggregate which can be utilized in this invention include those having various structures. In particular, the dyes represented by the following formula (I) are favored over others so far as facilitation of formation of an aggregate is concerned. It has been found that the dyes of the general formula (I), though exhibiting the absorption spectral characteristic of a monomer in the state of aqueous solution, caused a red shift in the absorption maximum when coated on a film (See Measurement Example). It is thought that this phenomenon results from the formation of an aggregate.

As for the monomer and the aggregate, details thereof are described, e.g., in T. H. James, *The Theory of the Photographic Process,* 4th ed., pp. 216–222.

It is essential for the dyes of this invention to have their absorption maxima within the range of 900 nm to 1,500 nm, but they may have other absorption maxima at wavelengths shorter than 900 nm. Formula (I)

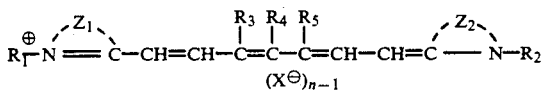

In the above formula, $Z_1$ and $Z_2$ each represents nonmetal atoms necessary to complete a substituted or unsubstituted benzothiazole, benzoselenazole, indole, naphthothiazole, naphthoselenazole or benzindole nucleus; $R_1$ and $R_2$ each represents a substituted or unsubstituted alkyl group; $R_3$ and $R_5$ are both hydrogen atom, or they each represents atoms necessary to complete a 5-membered ring by combining with each other; $R_4$ represents a hydrogen atom or a monovalent group (except those forming a ring among disubstituted amino groups); $X\ominus$ represents an anion; and n represents 1 or 2, but n is 1 when the dye molecule forms an inner salt.

This invention is concerned with a silver halide photographic light-sensitive material used preferably for the formation of black-and-white images, and having a silver coverage of 5 g/m$^2$ or less. Also, this invention consists of a method of detecting the position of light-sensitive materials, which comprises (1) designing a silver halide photographic light-sensitive material so as to have at least one hydrophilic colloid layer containing at least one dye represented by the formula (I) over a transparent support in a condition that it has its absorption maximum at a wavelength longer by at least 50 nm than that of the absorption maximum which it shows in aqueous solution, and the absorption maxima of the dye is within the range of 900 nm to 1,500 nm. (2) irradiating said light-sensitive materials with rays of wavelength longer by at least 50 nm than those of the spectral sensitivity maxima of said light-sensitive material, and which are longer than 750 nm, and (3) detecting whether or not said rays are screened by said light-sensitive material.

Dyes represented by the formula (I) are described in detail below.

Examples of substituent group(s) by which a benzothiazole, benzoselenazole, indole, naphthothiazole, naphthoselenazole or benzindole ring completed by non-metal atoms represented by $Z_1$ or $Z_2$ may be substituted include a sulfonic acid group, a carboxylic acid group, a hydroxyl group, halogen atoms (e.g., F, Cl, Br), a cyano group, substituted amino groups (e.g., dimethylamino, diethylamino, ethyl-4-sulfobutylamino, di(3-sulfopropyl)amino), and alkyl groups with one to five carbon atoms (e.g., methyl, ethyl, propyl, butyl) which may be substituted, preferably by a sulfonic acid group, a carboxylic acid group or a hydroxyl group and which may be bonded to the foregoing rings directly or through a divalent linkage group (e.g., —O—, —NH-CO—, —NHSO$_2$—, —NHCOO—, —NHCONH—, —COO—, —CO—, —SO$_2$—). Herein, the term sulfonic acid group is intended to include a sulfo group and salts thereof, and the term carboxylic acid group is intended to include a carboxyl group and salts thereof. Examples of such salts include those of alkali metals such as Na, K, etc., and those of ammonium and organic ammoniums such as triethyl ammonium, tributyl ammonium, pyridinium, etc.

Among these nuclei, benzindole nuclei containing at least one sulfonic acid group are particularly preferred over others.

Suitable examples of alkyl groups represented by $R_1$ and $R_2$ include lower alkyl groups having one to five carbon atoms (e.g., methyl, ethyl, n-propyl, n-butyl, isopropyl, n-pentyl), which may be substituted e.g., by a sulfonic acid group, a carboxylic acid group, a hydroxyl group. More preferred ones among these groups are lower sulfoalkyl groups having tow to five carbon atoms (e.g., 2-sulfoethyl, 3-sulfopropyl, 3-sulfobutyl, 4-sulfobutyl).

Examples of a 5-membered ring completed by combining $R_3$ with $R_5$ include indene and cyclopentene rings.

Suitable examples of the monovalent group represented by $R_4$ include lower alkyl groups such as a methyl group, etc., substituted or unsubstituted phenyl groups, aralkyl groups such as a benzyl group, etc., lower alkoxy groups such as a methoxy group, etc., disubstituted amino groups such as a dimethylamino group, a diphenylamino group, a methylphenylamino group, etc., alkylcarboxyloxy groups such as an acetoxy group, etc., alkylthio groups such as a methylthio group, etc., a cyano group, a nitro group, and halogen atoms such as F, Cl, Br, etc.

Specific examples of the anion represented by $X\ominus$ include halogen ions e.g., $Cl\ominus$, $Br\ominus$), a p-toluenesulfonic acid ion, an ethylsulfate ion, and so on.

Particularly preferred dyes among those described above are the compounds of formula (I) in which both $Z_1$ and $Z_2$ complete a sulfo-substituted benzindole ring, and both $R_1$ and $R_2$ represent a sulfoalkyl group.

Specific examples of dye compounds which are usable in this invention and represented by the formula (I) are illustrated below. However, this invention should not be construed as being limited to these examples.

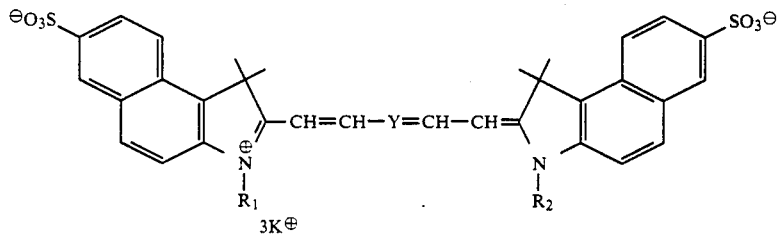

| Compound | $R_1$ | $R_2$ | Y |
|---|---|---|---|
| 1 | $-CH_2CH_2\underset{\underset{SO_3\ominus}{\vert}}{CH}CH_3$ | $-CH_2CH_2\underset{\underset{SO_3\ominus}{\vert}}{CH}CH_3$ | 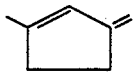 |
| 2 | $-CH_2CH_2CH_2SO_3\ominus$ | $-CH_2CH_2CH_2SO_3\ominus$ | " |
| 3 | " | " | $-CH=CH-CH=$ |
| 4 | $-CH_2CH_2\underset{\underset{SO_3\ominus}{\vert}}{CH}CH_3$ | $-CH_2CH_2\underset{\underset{SO_3\ominus}{\vert}}{CH}CH_3$ | " |

-continued
| Compound | $R_1$ | $R_2$ | Y |
|---|---|---|---|
| 5 | " | " | $H_5C_2O_2CH_2C$, $CH_2CO_2C_2H_5$ N |
| 6 | " | " | Cl |
| 7 | " | " | $CH_3$, Ph N |
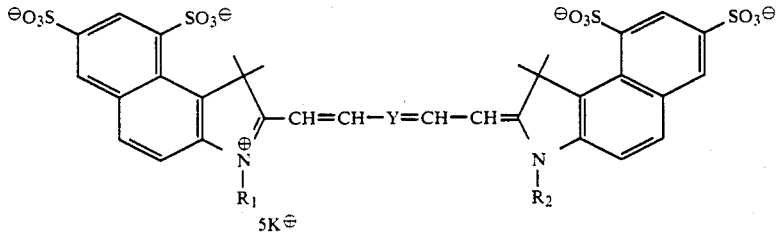
| | | | |
|---|---|---|---|
| 8 | $-CH_2CH_2CH(SO_3^{\ominus})CH_3$ | $-CH_2CH_2CH(SO_3^{\ominus})CH_3$ | $-CH=CH-CH=$ |
| 9 | $-CH_2CH_2CH_2SO_3^{\ominus}$ | $-CH_2CH_2CH_2SO_3^{\ominus}$ | " |
| 10 | " | " | $-CH=C(CH_3)-CH=$ |
| 11 | " | " | Cl |
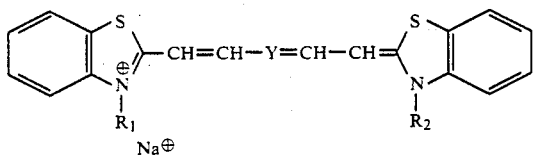
| | | | |
|---|---|---|---|
| 12 | $-CH_2CH_2CH(SO_3^{\ominus})CH_3$ | $-CH_2CH_2CH(SO_3^{\ominus})CH_3$ | $-CH=CH-CH=$ |
| 13 | $-CH_2CH_2CH_2SO_3^{\ominus}$ | $-CH_2CH_2CH_2SO_3^{\ominus}$ | $-CH=C(C_2H_5)-CH=$ |
| 14 | " | " | Cl |
| 15 | " | " | $CH_3$, Ph N |

-continued
| Compound | $R_1$ | $R_2$ | Y |
|---|---|---|---|
| 16 | " | " | 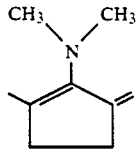 |
| 17 | 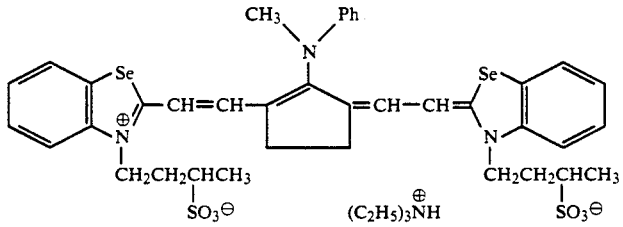 | | |
| 18 | 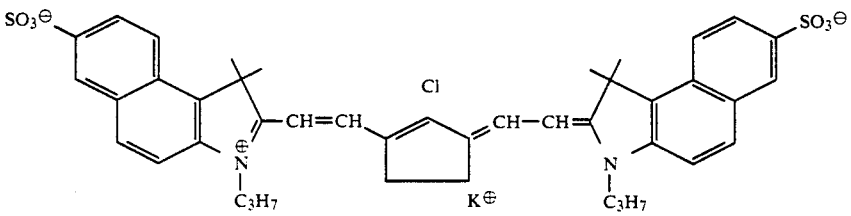 | | |
| 19 | 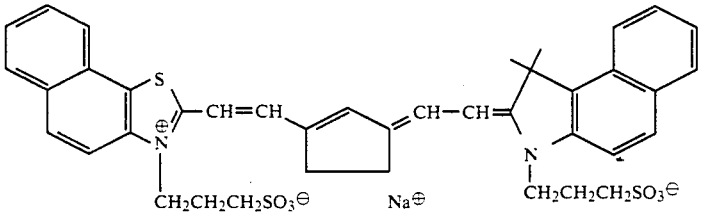 | | |
| 20 | 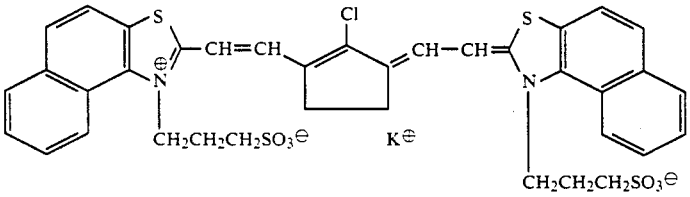 | | |
| 21 | 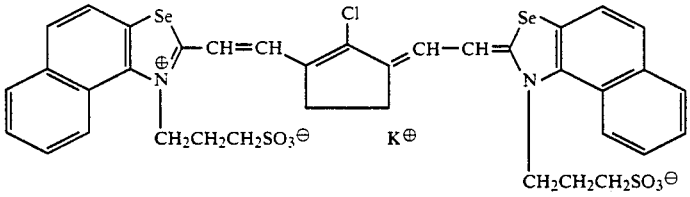 | | |
| 22 | 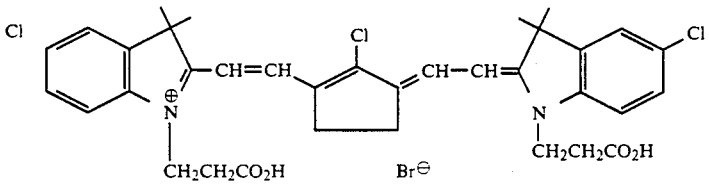 | | |
More preferred examples of dye compounds which are usable in this invention and represented by the formula (I) include Compound 1, Compound 3 and Compound 6.
The dyes of formula (I) can be synthesized according to methods as described in JP-A-46-14830; JP-A-52-110727; JP-A-62-123454; JP-A-63-5544; F. M. Hamer, *The Cyanine Dyes and Related Compounds,* Interscience Publishers (1964); and D. M. Sturmer, *Heterocyclic Compounds - Special Topics in Heterocyclic Chemistry,* John Wiley & Sons (1977).

The hydrophilic colloids of the present invention include any of those known to be usable for photography. An example of the hydrophilic colloid is gelatin.

Dyes useful for this invention can be used in an amount sufficient enough to filter or absorb infrared rays. In particular, it is of great advantage to use them in such an amount and a position that they may be solubilized and eluted in the course of development. For instance, a small amount of dyes is required when it is desirable to absorb light only in small quantity, whereas when it is desired that light should be absorbed in larger quantity, the dyes can be used in the larger amount so long as they remain on a coloration level acceptable for special photographic elements. More specifically, it is desirable that the dyes should be present in a photographic element at a coverage ranging from 0.1 to 1,000 $mg/m^2$, preferably from 1 to 800 $mg/m^2$. Also, the dyes of formula (I) may be used independently or as a mixture.

Photographic processing of the light-sensitive material of this invention, can be accompanied by any known methods and processing solutions for black-and-white photographic processing as described, e.g., in *Research Disclosure,* vol. 176, pp. 28–30 (RD-17643). A processing temperature is generally chosen from the range of 18° C. to 50° C. Though the photographic processing can be performed at temperatures lower than 18° C. or higher than 50° C., this invention prefers to adopt the photographic processing with an auto-developing machine whose processing temperatures are set to the 20° C. to 40° C. region. In this case, a processing time (which refers to the period from insertion of a light-sensitive material until discharge thereof at the conclusion of drying) ranges preferably from 10 sec. to 5 min., and particularly preferably from 15 sec. to 3.5 min.

A developing solution which can be used for the black-and-white photographic processing can contain known developing agents. As the developing agent, dihydroxybenzenes (e.g., hydroquinone), 3-pyrazolidones (e.g., 1-phenyl-3-pyrazolidone) and aminophenols (e.g., N-methyl-p-aminophenol) can be employed individually or in combination of two or more thereof. In addition to such developing agents, the developing solution generally contains known preservatives, alkali agents, pH buffers and antifoggants, and further may contain dissolution aids, toning agents, development accelerators (e.g., quaternary salts, hydrazine, benzyl alcohol), development inhibitors (e.g., iodides, bromides, mercapto compounds, triazoles), surfactants, defoaming agents, water softeners, hardeners (e.g., glutaraldehyde), viscosity imparting agents, and so on, if desired.

In a special form of development-processing which can be adopted, a developing agent is incorporated in a light-sensitive material, more specifically in an emulsion layer thereof, and the light-sensitive material is processed with an aqueous alkali solution to achieve the development. When the desired developing agent is hydrophobic, it can be incorporated into an emulsion layer in accordance with various methods disclosed, e.g., in *Research Disclosure,* Vol. 169 (RD-16928), U.S. Pat. No. 2,739,890, British Patent 813,253, and West German Patent 1,547,763. The development processing of such a form may be carried out in combination with the silver salt stabilization processing using a thiocyanate.

A fixer which can be used includes those having conventionally used compositions. As for the fixing agent, not only thiosulfates and thiocyanates but also organic sulfur compounds known to be effective as a fixing agent can be used. The fixer may contain a water-soluble aluminum salt as a hardener.

The effects of this invention can be heightened by the combined use with such compounds as to release an inhibitor upon development, as disclosed in JP-A-61-230135 and JP-A-63-25653.

Silver halides contained in light-sensitive silver halide emulsions which can be used in this invention include silver chlorobromide, silver bromide, silver iodobromide and silver chloroiodobromide. Among them, silver iodobromide is preferred over others. A preferred iodide content therein is 30 mol% or less, particularly 10 mol% or less. The distribution of iodide inside the silver iodobromide grains may be uniform throughout, or may differ between the inner part and the surface part thereof. An average grain size is preferably 0.4 μm or above, and particularly preferably ranges from 0.5 to 2.0 μm. The distribution of sizes among grains may be narrow or broad.

The silver halide grains in emulsions may have a regular crystal form, such as that of a cube, an octahedron, a tetradecahedron or rhombic dodecahedron; an irregular crystal form, such as that of a sphere, a plate, a pebble or so on; or a composite form thereof. A mixture of various crystal forms of silver halide grains may be also present. It is also desirable in this invention to use tabular grains having an aspect ratio (or a ratio of a grain diameter to a thickness) of 5 or more (details of which are described, e.g., in *Research Disclosure,* Vol. 225, Item 22534, pp. 0–58 (January 1983), JP-A-58-127921, and JP-A-58-113926).

The light-sensitive silver halide emulsion used in this invention may be a mixture of two or more kinds of silver halide emulsions. The emulsions mixed may differ from one another in grain size, halide composition, sensitivity and so on. A light-sensitive emulsion and as light-insensitive (in a substantial sense) emulsion (which may be fogged at the surface of or inside the grains) may be used as a mixture, or in separate layers (as disclosed in U.S. Pat. Nos. 2,996,382 and 3,397,987). For instance, spherical or pebble-like light-sensitive emulsion grains and tabular light-sensitive emulsion grains having an aspect ratio of 5 or more may be used in the same layer, or in separate layers as disclosed in JP-A-58-127921. When used in separate layers, the light-sensitive emulsion comprising tabular silver halide grains may be arranged on the side nearer to or farther from the support.

The photographic emulsions which may be used in this invention can be prepared using various methods as described in, for example, P. Glafkides, *Chemie et Phisique Photographique,* Paul Montel, Paris (1967), G. F. Duffin, *Photographic Emulsion Chemistry,* The Focal Press, London (1966), V. L. Zelikman et al, *Making and Coating Photographic Emulsion,* The Focal Press, London (1964); JP-A-58-127921 and JP-A-58-113926; and so on. Specifically, any processes including an acid process, a neutral process and an ammoniacal process may be employed.

Suitable methods for reacting a water-soluble silver salt with a water-soluble halide include, e.g., a single jet method, a double jet method, or a combination thereof.

Also, a method in which silver halide grains are produced in the presence of excess silver ion (the so-called reverse mixing method) can be employed. On the other hand, the controlled double jet method, in which the pAg of the liquid phase in which silver halide grains are to be precipitated is maintained constant, may be also employed. According to this method, a silver halide emulsion which comprises the grains having a regular crystal form and an almost uniform grain size can be obtained.

As for the crystal structure of silver halide grains, the grains may be uniform throughout, or the interior and the surface of the grains may differ form each other to assume a layer structure, or the grains may be of the so-called conversion type as disclosed in British Patent 635,841 and U.S. Pat. No. 3,622,318.

At a grain forming or physical ripening stage for the preparation of a silver halide emulsion, cadmium salts, zinc salts, lead salts, thallium salts, iridium salts or complexes, rhodium salts or complexes, iron salts or complexes, and/or the like may be present.

In a process for grain formation, silver halide solvents such as ammonia, thioether compounds, thiazolidine-2-thiones, tetrasubstituted thioureas, potassium thiocyanate, ammonium thiocyanate and amine compounds may be also present for the purpose of controlling the grain growth.

The silver halide emulsions used in this invention may or may not be chemically sensitized.

Chemical sensitization can be effected using a sulfur sensitization process, reduction sensitization process, gold sensitization process or other known process. These processes may be used individually or as a combination thereof.

The gold sensitization process is representative of the noble metal sensitization processes, and utilizes gold compounds, mainly gold complexes. Therein, complexes of noble metals other than gold, such as platinum complexes, palladium complexes, iridium complexes and the like, may be used. Specific examples of such processes are disclosed in U.S. Pat. No. 2,448,060, British Patent 618,061, and so on.

Examples of suitable sulfur sensitizers which can be used include sulfur compounds contained in gelatin, and other various sulfur compounds such as thiosulfates, thioureas, thiazoles, rhodanines and the like.

Examples of suitable reducing sensitizers which can be used include stannous salts, amines, formamidine sulfinic acid, silane compounds, and so on.

The photographic emulsions used in this invention can obtain a wide variety of compounds for the purpose of preventing fog or stabilizing photographic functions during the preparation, storage, or photographic processing of light-sensitive materials. More specifically, various compounds which have so far been known as antifoggants or stabilizers, such as azoles (e.g., benzothiazolium salts, nitroimidazoles, nitrobenzimidazoles, chlorobenzimidazoles, bromobenzimidazoles, nitroindazoles, benzotriazoles, aminotriazoles), mercapto compounds (e.g., mercatothiazoles, mercaptobenzothiazoles, mercaptobenzimidazoles, mercaptothiadiazoles, mercaptotetrazoles (especially 1-phenyl-5-mercaptotetrazole), mercaptoyrimidines, mercaptotriazines), thioketo compounds (e.g., oxazolinethione), azaindenes (e.g., triazaindenes, tetraazindenes (especially 4-hydroxy substituted (1,3,3a,7-tetraazaindenes), pentaazaindenes), benzenethiosulfonic acid, benzenesulfinic acid, benzenesulfonic acid amide, and so on can be added.

In particular, nitron and its derivatives disclosed in JP-A-60-76743 and JP-A-60-87322, the mercapto compounds disclosed in JP-A-60-80839, the heterocyclic compounds disclosed in JP-A-57-164735, heterocyclic compound-silver complex salts (e.g., 1-phenyl-5-mercaptotetrazole-silver complex), for example, can be used advantageously.

Spectral sensitivities, or sensitivities to blue light of relatively longer wavelengths, green light, and red or infrared light, may be imparted to the light-sensitive silver halide emulsions used in this invention by the addition of sensitizing dyes. Sensitizing dyes which can be used include cyanine dyes, merocyanine dyes, complex cyanine dyes, complex merocyanine dyes, holopolar cyanine dyes, styryl dyes, hemicyanine dyes, oxonol dyes, hemioxonol dyes and so on.

Such sensitizing dyes can be present in any process for preparing photographic emulsions, or at any stage from the conclusion of the preparation until the beginning of the coating. Therein, processes for the preparation include a grain-formation process, a physical ripening process, a chemical ripening process, and so on.

The photographic emulsion layers and other hydrophilic colloid layers of the light-sensitive material of this invention may contain various kinds of surface active agents for a wide variety of purposes, for instance, as a coating aid, prevention of generation of static charges, improvement in slipability, improvement in emulsifying dispersion, prevention of generation of adhesion, improvements in photographic characteristics (e.g., acceleration of development, increase in contrast, sensitization, etc.), and so on.

Examples of suitable surface active agents include nonionic surface active agents such as saponin (steroid type), alkyleneoxide derivatives (e.g., polyethylene glycol, polyethylene glycol/polypropylene glycol condensates, polyethylene glycol alkyl ethers or polyethylene glycol alkyl aryl ethers, polyethylene oxide adducts of silicon, etc.), alkyl esters of sugars, and so on; anionic surface active agents such as alkylsulfonates, alkylbenzenesulfonates, alkylnaphthalenesulfonates, alylsulfates, N-acyl-N-alkyltaurines, sulfosuccinic acid esters, sulfoalkylpolyoxyethylene alkyl phenyl ethers, and so on; amphoteric surface active agents such as alkylbetaines, alkylsulfobetaines, and so on; and cationic surface active agents such as aliphatic or aromatic quaternary ammonium salts, pyridinium salts, imidazolium salts, and so on. Among these surface active agents, those preferred in particular in this invention are anionic ones including sodium dodecylbenzenesulfonate, disodium 2-ethylhexyl-α-sulfosuccinate, sodium p-octylphenoxyethoxyethoxyethanesulfonate, sodium dodecylsulfate, sodium triisopropylnaphthalenesulfonate and sodium N-methyloleoyltaurine; betaines including dodecyltrimethylammonium chloride, N-oleoly-N',N',N'-trimethylammoniodiaminopropane bromide and dodecylpyridium chloride; and nonionic ones including saponin, polyoxyethylene (average polymerization degree (n)=10) cetyl ether, polyoxyethylene (n=25) p-nonlyphenol ether and bis(1-polyoxyethylene (n=15)-oxy-2,4-di-t-pentylphenyl)ethane.

Examples of antistatic agents which can be preferably used include fluorine-containing surface active agents, such as potassium perfluorooctanesulfonate, sodium N-propyl-N-perfluorooctanesulfonylglycine, sodium N-propyl-N-perfluorooctanesulfonylaminoethyloxypolyoxyethylene (N=3) butane sulfonate, N-perfluorooctanesulfonyl-N', N',N'-trimetylammoniodiaminopropane chloride and N-perfluorodecanoylaminopropyl-N', N'-dimethyl-N'-carboxybetaine; nonionic surface active agents disclosed, e.g., in JP-A-60-80848, JP-A-61-112144, Japanese Patent Application Nos. 61-13398 and 61-16056 (corresponding to JP-A-62-172343 and JP-A-62-173459, respectively); nitrates of alkali metals; conductive tin oxide; zinc oxide, vanadium pentaoxide and complex oxides formed by doping these oxides with antimony or the like.

Examples of a matting agent which can be used in this invention include fine grains of organic compounds such as methylmethacrylate homopolymer, methylmethacrylate-methacrylic acid copolymer, starch, etc., and fine grains of inorganic compounds such as silica, titanium dioxide, etc. A suitable grain size thereof ranges from 1.0 to 10 μm, particularly from 2 to 5 μm.

In a surface layer of the photographic light-sensitive material of this invention, silicone compounds disclosed, e.g., in U.S. Pat. Nos. 3,489,576 and 4,047,958, colloidal silica disclosed in JP-B-56-23139 (The term "JP-B" as used herein means an "examined Japanese patent publication"), paraffin wax, higher fatty acid esters, starch derivatives or so on can be used as lubricant.

In hydrophilic colloid layers of the photographic light-sensitive material of this invention, polyols such as trimethylolpropane, pentanediol, butanedoil, ethylene glycol, glycerine and the like can be used as plasticizer. Further, it is desirable that the hydrophilic colloidal layers should contain a polymer latex, for the purpose of improvement in pressure resistance. Suitable polymers to form the latex include alkylacrylate homopolymers, alkylacrylate-acrylic acid copolymers, styrene-butadiene copolymer, and homo- and copolymers containing as a constituent monomer an active methylene group-containing monomer.

The photographic emulsions and light-insensitive hydrophilic colloids of this invention may contain inorganic or organic hardeners. Suitable examples of hardeners which can be used include chromium salts, aldehydes (e.g., formaldehyde, glutaraldehyde), N-methylol compounds (e.g., dimethylol urea), active vinyl-containing compounds (e.g., 1,3,5-triacrylolylhexahydro-s-trizine, bis(vinylsulfonyl)methyl ether, N,N'-methylenebis(β-(vinylsulfonyl)propionamide), active halogen-containing compounds (e.g., 2,4-dichloro-6-hydroxy-s-triazine), mucohalic acids (e.g., mucochloric acid), N-carbamoylpyridinium salts (e.g., (1-morpholinocarbonyl-3-pyridinio)methanesulfonate), haloamidinium salts (e.g., 1-(1-chloro-1-pyridinomethylene)pyrrolidinium 2-naphthalenesulfonate), and so on. These hardeners can be used alone or in combination. In particular, active vinyl-containing compounds disclosed in JP-B-53-41220, JP-B-53-57257, JP-B-59-162546 and JP-B-60-80846, and active halogen-containing compounds disclosed in U.S. Pat. No. 3,325,287 are preferred over others.

When the light-sensitive material of this invention is employed as X-ray sensitive material, it is desired that the hydrophilic colloid layers should be hardened by such a hardener as cited above so that their swelling degree in water may be controlled to 300% or less, especially 250% or less.

As for the binder or protective colloid which can be used in the emulsion layers and the interlayers to constitute the light-sensitive material of this invention, gelatin is used advantageously. Of course, other hydrophilic colloids can be also used.

Specific examples of hydrophilic colloids which can be used include various kinds of synthetic hydrophilic macromolecular substances such as homo- or copolymers including dextran, polyvinyl alcohol, partial acetal of polyvinyl alcohol, poly-N-vinylpyrrolidone, polyacrylic acid, polyacrylamide, polyvinylimidazole and so on.

Gelatin which can be used include not only lime-processed gelatin, but also acid-processed gelatin and enzyme-processed gelatin. In addition, hydrolysis products of gelatin can be also used.

As the binder of this invention, it is most preferred to use gelatin together with dextran and poly-acrylamide.

The development-processing of this invention can be performed with reference to the descriptions in the above-cited volumes of Research Disclosure, RD-17643, (December, 1978).

The light-sensitive materials of this invention can shut off infrared rays efficiently, so a detection probability with an infrared sensor is enhanced. In addition, they are almost free from color contamination after photographic processing.

This invention will now be illustrated in greater detail by reference to the following measurements and examples.

MEASUREMENT EXAMPLE

Absorption of Light by Dyes in Aqueous Solution and in Gelatin Film:

To 5 ml of a 5% aqueous solution of gelatin was added 1 ml of a 0.2% solution of each of the dyes set forth in Table 1. Each of these dye solutions was coated on a cellulose triacetate film, dried, and examined for the absorption of light thereby.

Separately, absorption spectra of the foregoing dyes in the aqueous solutions were measured.

Results of the measurements are shown in Table 1.

| Compound | λmax in $H_2O$ | λmax in Film | Half Width* | Δλmax |
|---|---|---|---|---|
| 1 (Invention) | 821.6 nm | 949.6 nm | 35.0 nm | 128 nm |
| 3 (Invention) | 780.0 nm | 910.0 nm | 32.5 nm | 130 nm |
| 6 (Invention) | 840.0 nm | 985.0 nm | 30.0 nm | 145 nm |
| A (Comparison) | 716.6 nm | 816.0 nm | 92.0 nm | 100 nm |

-continued

| Compound | λmax in $H_2O$ | λmax in Film | Half Width* | Δλmax |
|---|---|---|---|---|
| B (Comparison) | 813.0 nm | 833.0 nm | 130.0 nm | 20 nm |

Dye A for Comparison:

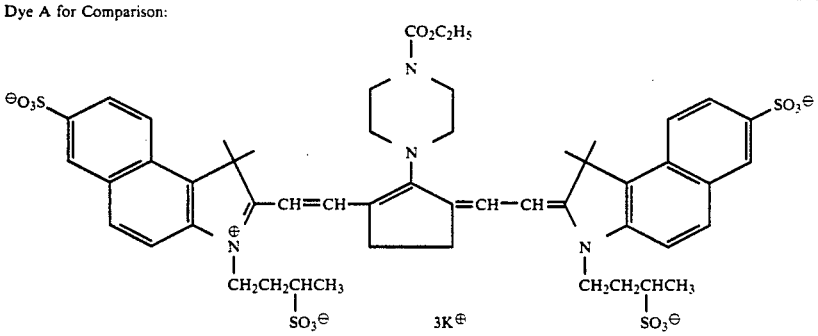

Dye B for Comparison:

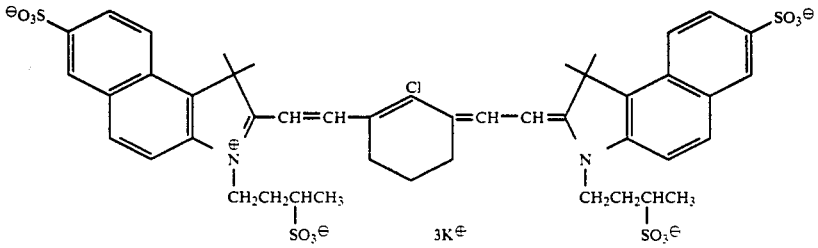

*half width: difference between the wavelengths at which the absorbance is one-half the maximum absorbance.
Δλmax: Δmax in film − λmax in water.

As can be seen from the data in Table 1, the dyes of this invention had absorption characteristics adequate for detection of the position at which a light-sensitive material is present.

EXAMPLE 1

(1) Preparation of Silver Halide Emulsion

After a liquid equivalent quantity of ammonia was admitted into a container in which gelatin, potassium bromide and water had been placed and warmed to 55° C., an aqueous solution of silver nitrate and an aqueous solution of potassium bromide were added according to a double jet method as the pAg in the reaction container was kept as 7.60 to prepare a monodisperse silver bromide emulsion grains having an average grain size of 0.55 μm. In the course of the grain formation, $K_4Ru(CN)_6$ was added in an amount of $1\times10^{-5}$ mol/mol Ag. 98% of the thus formed emulsion grains had their individual sizes within the range of the average grain size ±40%. After this emulsion was desalted, and then adjusted to pH 6.2 and pAg 8.6, it was subjected to gold-sulfur sensitization with sodium thiosulfate and chloroauric acid. Thus, the intended photographic emulsion (named Emulsion A) was obtained. A ratio of (100) surface to (111) surface in this photographic emulsion was 98/2 when determined by the Kubelka-Munk method.

(2) Preparation of Coating Composition for Emulsion Layer

An one gram portion of Emulsion A was weighed out, and made to dissolve by warming it to 40° C. Thereto, 70 ml of a methanol solution of the near infrared sensitizing dye having the structural formula S-1 ($9\times10^{-4}$ N/l), an aqueous solution of 4-hydroxy-6-methyl-1,3,3a,7-tetrazaindene, an aqueous solution of a dodecylbenzenesulfonate (as coating aid) and an aqueous solution of poly(potassium-p-vinylbenzenesulfonate) (as viscosity increasing agent) were added to prepare a coating composition.

S-1:

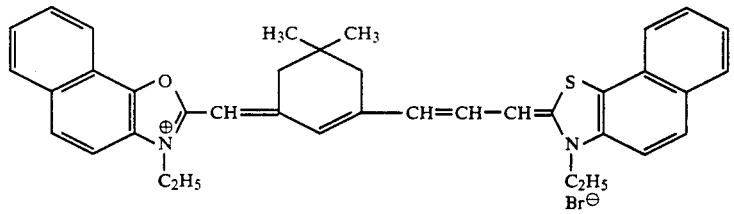

(3) Preparation of Coating Composition for Surface Protecting Layer on Light-Sensitive Layer To a 10 wt% aqueous solution of gelatin warmed to 40° C. were added an aqueous solution of sodium polyethylenesulfonate as viscosity increasing agent, fine grains of polymethylmethacrylate as matting agent (average grain size: 3.0 μm), N,N'-ethylenebis(vinylsulfonylacetamide) as hardener, an aqueous solution of sodium t-octylphenoxyethoxyethanesulfonate. as coating aid, and an aqueous solution of a surface active agent of polyethylene type and an aqueous solution of the fluorine-containing compounds having the formulae, $C_8F_{17}SO_2N(C_3H_7)CH_2COOK$ and $C_8F_{17}SO_2N(C_3H_7)(CH_2CH_2)_{15}H$, as antistatic agent.

(4) Preparation of Coating Compositions for Backing Layer

To an 1 kg portion of a 10 wt% aqueous solution of gelatin warmed to 40° C. were added 1.75 g of Dye-1 having the following structural formula, an aqueous solution of sodium polyethylenesulfonate as viscosity increasing agent, an aqueous solution of N,N'-ethylene-bis-(vinylsulfonylacetamide) as hardener and an aqueous solution of sodium t-octylphenoxyethoxyethanesulfonate as coating aid to prepare a coating composition for a backing layer. Other coating compositions were prepared using the dyes of this invention and the dyes for comparison set forth in Table 2, respectively, in the place of Dye-1.

Dye-1:

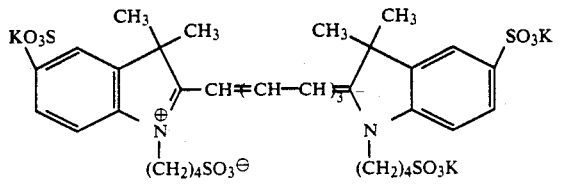

(5) Preparation of Coating Composition for Surface Protecting Layer on Backing Layer To a 10 wt% aqueous solution of gelatin warmed to 40° C. were added an aqueous solution of sodium polyethylenesulfonate as viscosity increasing agent, fine grains of polymethylmethacrylate as matting agent average grain size: 3.0 μm), an aqueous solution of sodium t-octylphenoxyethoxyethanesulfonate as coating aid, and an aqueous solution of a surface active agent of polyethylene type and an aqueous solution of the fluorine-containing compounds having the formulae, $C_8F_{17}SO_2N(C_3H_7)CH_2COOK$ and $C_8F_{17}SO_2N(C_3H_7)(CH_2CH_2O)_{15}H$, as antistatic agents.

(6) Sample Making by Coating Operations

Each of the foregoing coating compositions for backing layers and the above-described coating composition for protecting the surface of a backing layer were coated simultaneously on one side of the following polyethylene terephthalate support so as to have a gelatin coverage of 4 g/m². Subsequently, on the opposite side of the support were coated firstly the coating composition comprising Emulsion A wherein the near infrared sensitizing dye was contained, and then the coating composition for protecting the surface of the coated emulsion. Therein, a silver coverage was adjusted to 3.5 g/m². Thus, samples according to this invention and for comparison were obtained.

(7) Support

A 175 μm-thick biaxially stretched polyethylene terephthalate film was subjected to a corona discharge treatment, coated with a first subbing layer composition constituted by the following ingredients at a coverage of 5.1 ml/m² by means of a wirebar coater, and then dried for 1 min. at 175° C. Further, the first subbing layer composition was coated on the opposite side also in a similar manner as described above.

| Composition of First Subbing Layer: | |
|---|---|
| Butadiene-styrene copolymer latex solution* (solids concentration: 40%, butadiene/styrene ratio: | 79 ml |

-continued

| Composition of First Subbing Layer: | |
|---|---|
| 31/69 by weight) | |
| Sodium 2,4-dichloro-6-hydroxy-s-triazine (4% solution) | 20.5 ml |
| Distilled water | 900.5 ml |

*The latex solution contained a compound of the formula, $$\begin{array}{l} n\text{-}C_6H_{13}OOCCH_2 \\ \quad\quad | \\ n\text{-}C_6H_{13}OOCCH{-}SO_3Na, \end{array}$$

as an emulsifying and dispersing agent in a proportion of 0.4 wt % to the latex solid component therein.

On the first subbing layer on either side of the film a second subbing layer composition constituted by the following ingredients was successively coated so as to have a coverage of 8.5 ml/m² on each side, and dried to complete a support film provided with the subbing layers on both sides.

| Composition of Second Subbing Layer: | |
|---|---|
| Gelatin | 30 g |
| 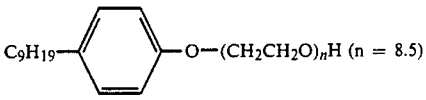 | 0.2 g |
| Matting agent (polymethylmethacrylate fine grains with an average grain size of 2.5 μm) | 0.3 g |
| 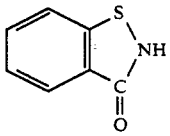 | 0.035 g |
| Water to make | 1 l |

Each sample was subjected successively to exposure, development, fixation, washing and drying processing operations described below using an imagewise exposure device and an auto-developing machine.

The exposure was carried out with semiconductor laser beams of 780 nm, the scan time of which was set to $10^{-7}$ sec.

After the exposure, the development and the fixation were carried out using the following developer and fixer, respectively. In the photographic processing, a standard development temperature of 35° C. was adopted, and a total processing time, including those in fixation, washing and drying in addition to a development time, was controlled to 70 seconds.

| Composition of Developer: | |
|---|---|
| Sodium hydroxide | 16.98 g |
| Glacial acetic acid | 1.8 g |
| Sodium sulfite | 60 g |
| Potassium hydrogen carbonate | 5.0 g |
| Boric acid | 3.0 g |
| Diethylene glycol | 12.0 g |
| Diethylenetriaminepentaacetic acid | 2.0 g |
| 5-Methylbenzotriazole | 0.6 g |
| Hydroquinone | 25.0 g |
| 4-Hydroxymethyl-4-methyl-1-phenyl-3-pyrazolidone | 1.65 g |
| Potassium bromide | 2.0 g |
| Water to make | 1 l |
| (The pH was adjusted to 10.25) | |
| Composition of Fixer: | |
| Ammonium thiosulfate | 140 g |

-continued

| | |
|---|---|
| Sodium sulfite (anhydrous) | 15 g |
| Disodium ethylenediaminetetra acetate dihydrate | 0.025 g |
| Water to make | 1 l |
| (The pH was adjusted to 5.1 with glacial acetic acid.) | |

Evaluation of Color Contamination

The extent of color contamination was evaluated by visual observation of Dmin.

O: no problem in practical use.

X: some problem in practical use.

<Detection probability with Sensor>

Ten sheets of each sample were inserted one after another into the film insertion inlet of an auto-developing machine, and examined as to whether the insertion of each sheet was detected or not.

This auto-developing machine had a pair of infrared-ray emission and reception elements (See FIG. 1 and FIG. 2, respectively) on the inside of the film insertion inlet, and was designed so as to recognize the insertion of a sample sheet through adequate shut-off of infrared rays by the inserted sample sheet, and thereby so as to make the conveyer rollers start to revolve, resulting in conveyance of the sample sheet (film) to the developing tank.

<Fixability upon 25% Reduction in Fixer Replenishment>

The running processing was carried out under another condition that the foregoing fixer was replenished in an amount reduced to ¾ the full amount, and a level of fixation was evaluated.

O: no problem in practical use.

X: poor fixation (inadequate for practical use).

TABLE 2

| Sample | *Dye (mg/m²) | Detection Probability** | Color Contamination | Fixability*** |
|---|---|---|---|---|
| 1 (Comparison) | — | 0 | ○ | ○ |
| 2 (Invention) | 1 (50) | 10 | ○ | ○ |
| 3 (Invention) | 3 (80) | 10 | ○ | ○ |
| 4 (Invention) | 6 (80) | 10 | ○ | ○ |
| 5 (Comparison) | A (200) | 2 | ○ | ○ |
| 6 (Comparison) | B (200) | 3 | ○ | ○ |
| 7 (Comparison) | C (7.5) | 10 | X | X |
| 8 (Comparison) | (light scattering grains) | 8 | ○ | X |

*Dye compound of this invention or Dye for comparison contained in the backing layer for detection with a sensor (coverage per one side).

**by means of a sensor, expressed in terms of the number of detected sheets in 10 sheets.

***in the case of 25% reduction in replenishment of the fixer.

Sample 7 was prepared in the same manner as in JP-A-62-299959. Specifically, chemically unripened silver iodobromide emulsion grains having an average grain size of 0.19 μm (Ag content: 0.27 g/m²) and Dye C for comparison (7.5 mg/m²) were mixed in advance, and then added to a coating composition for the dye layer. The resulting coating composition was coated.

Dye C for Comparison:

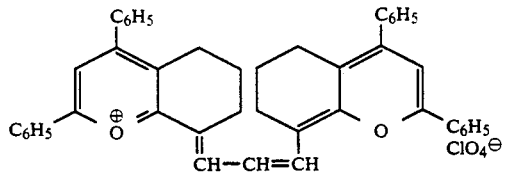

In Sample 8, light-scattering particles were incorporated in accordance with JP-A-63-131135. (More specifically, the chemically unripened silver iodobromide emulsion having an average grain size of 0.72 μm was coated at a coverage of 0.22 g/m²).

As can be seen from the data in Table 2, the samples of this invention were excellent in detection probability with a sensor and in fixability, and free from color contamination, that is, filled all the requirements. As for the wavelengths at which the samples showed their absorption maxima, the same results as in Measurement Example were obtained. On the other hand, Sample 7 had a serious color contamination problem because the dye with low solubility in water was used therein.

EXAMPLE 2

A 175 μm-thick biaxially stretched polyethylene terephthalate film was subjected to a corona discharge treatment, coated with a first subbing layer composition constituted by the following ingredients at a coverage of 5.1 ml/m² by means of a wirebar coater, and then dried for 1 min. at 175° C. Further, the first subbing layer composition was coated on the opposite side also in a similar manner as described above.

| Composition of First Subbing Layer: | |
|---|---|
| Butadiene-styrene copolymer latex solution* (solids concentration: 40%, butadiene/styrene ratio: 31/69 by weight) | 79 ml |
| Sodium 2,4-dichloro-6-hydroxy-s-triazine (4% solution) | 20.5 ml |
| Distilled water | 900.5 ml |

*The latex solution contained a compound of the formula, $$\begin{array}{l} n\text{-}C_6H_{13}OOCCH_2 \\ \quad\quad\quad | \\ n\text{-}C_6H_{13}OOCCH{-}SO_3Na, \end{array}$$

as an emulsifying dispersing agent in a proportion of 0.4 wt % to the latex solid component therein.

On the first subbing layer on either side of the film, a second subbing layer composition constituted by the following ingredients was successively coated so as to have a coverage of 8.5 ml/m² on each side, and dried to complete a support film provided with the subbing layers on both sides.

| Composition of Second Subbing Layer: | |
|---|---|
| Gelatin | 30 g |
| Dye | 4.7 g |

-continued

| Composition of Second Subbing Layer: | |
|---|---|
| 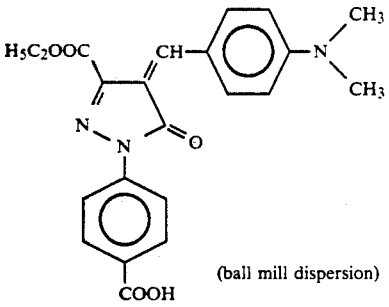 (ball mill dispersion) | |
| 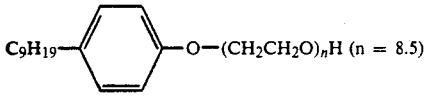 | 0.2 g |
| Matting agent (polymethylmethacrylate fine grains with an average grain size of 2.5 μm) | 0.3 g |
| 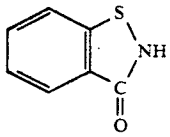 | 0.035 g |
| Water to make | 1 l |

Preparation of Coating Composition for Emulsion Layer

To one liter of water were added 5 g of potassium bromide, 0.05 g of potassium iodide, 30 g of gelatin, and 2.5 ml of a 5% aqueous solution of thioether represented by the formula, $HO(CH_2)_2S(CH_2)_2S(CH_2)_2OH$. The resulting solution was stirred and kept at 73° C. Thereto, an aqueous solution containing 8.33 g of silver nitrate and an aqueous solution containing 5.94 g of potassium bromide and 0.726 g of potassium iodide were added in a 45-second period according to a double jet method. Subsequently, 2.5 g of potassium bromide was added, and then an aqueous solution containing 8.33 g of silver nitrate was added over a period of 7.5 min. Therein, a flow rate at the conclusion of the addition was controlled so as to become two times as high as that at the beginning of the addition. Then, an aqueous solution containing 153.34 g of silver nitrate and an aqueous solution containing a mixture of potassium bromide and potassium iodide were further added over a 25-minute period in accordance with a controlled double jet method, in which pAg was maintained at 8.1 and the addition was accelerated so that the flow rate at the conclusion of the addition might be increased to 8 times that at the beginning of the addition. Thereafter, 15 ml of a 2N potassium thiocyanate solution was added and then, 50 ml of a 1% aqueous solution of potassium iodide was further added over a 30-second period. The thus prepared emulsion was cooled to 35° C., and therefrom were removed soluble salts by the flocculation method. Then, the resulting emulsion was warmed to 40° C., and thereto were added 68 g of gelatin, 2 g of phenol and 7.5 g of trimethylol propane. Furthermore, the emulsion was adjusted to pH 6.55 and pAg 8.10 by using sodium hydroxide and potassium bromide.

After the temperature of the emulsion was raised to 56° C., 175 mg of 4-hydroxy-6-methyl-1,3,3a,7-tetrazaindene and 625 mg of a sensitizing dye having the following structural formula were added. After a 10-minute lapse, 5.5 mg of sodium thiosulfate pentahydrate, 163 mg of potassium thiocyanate and 3.6 mg of chloroauric acid were added, and allowed to stand for 5 minutes. Then, the emulsion was rapidly cooled to solidify the emulsion. 93% of the whole grains contained in the thus obtained emulsion, based on projected area, are grains having an aspect ratio of 3 or above, the means of projected area diameters of all grains having an aspect ratio of 2 or above was 0.95 μm, the standard deviation of the grain diameters was 23%, the average thickness of the grains was 0.155 m, and the average aspect ratio was 6.1.

Structural Formula of Sensitizing Dye

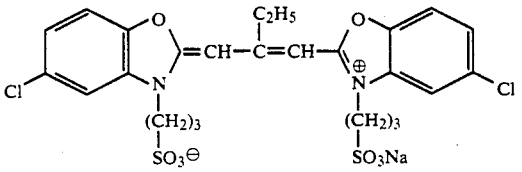

To this emulsion, the ingredients set forth below were added in the following amounts, respectively, per mole of silver halide to prepare a coating composition.

| | |
|---|---|
| 2,6-Bis(hydroxyamino)-4-diethylamino-1,3,5-triazine | 80 mg |
| Sodium polyacrylate (average molecular weight: 41,000) | 4.0 g |
| 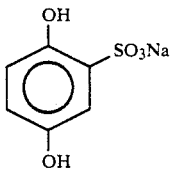 | 9.7 g |
| Copolymeric plasticizer [ethylacrylate/acrylic acid/methacrylic acid (95/2/3) copolymer] | 20.0 g |
| Nitron | 50 g |
| 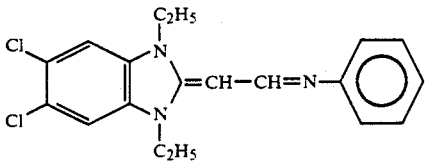 | 5.0 mg |

The thus prepared coating composition and the surface protecting composition described below were coated on both sides of the foregoing support according to the simultaneous extrusion method. Therein, coverages of ingredients in the dye layer, the emulsion layer and the surface protecting layer were as follows on each side.

<Dye Layer>

-continued

| | |
|---|---|
| Dye | described in Table 3 |
| Gelatin | 0.4 g/m$^2$ |
| <Emulsion Layer> | |
| Silver | 1.5 g/m$^2$ |
| Gelatin | 1.5 g/m$^2$ |
| <Surface Protecting Layer> | |
| Gelatin | 0.81 g/m$^2$ |
| Dextran (average molecular weight: 39,000) | 0.81 g/m$^2$ |
| Matting agent (average grain diameter: 3.5 μm), methylmethacrylate/methacrylic acid (9/1) copolymer | 0.06 g/m$^2$ |
| 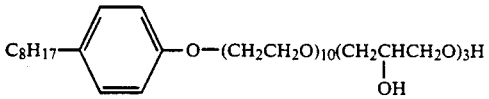 | 60 mg/m$^2$ |
| 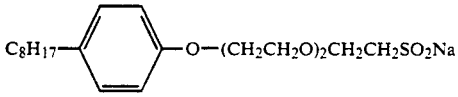 | 20 mg/m$^2$ |
| $C_8F_{17}SO_2N(C_3H_7)(CH_2CH_2O)_4(CH_2)SO_3Na$ | 2 mg/m$^2$ |
| $C_8F_{17}SO_2N(C_3H_7)(CH_2CH_2O)_{15}H$ | 5 mg/m$^2$ |
| 4-Hydroxy-6-methyl-1,3,3a,7-tetrazaindene | 15.5 mg/m$^2$ |
| Sodium polyacrylate (average molecular weight: 41,000) | 70 mg/m$^2$ |

As a hardener, 1,2-bis(sulfonylacetamido)ethane was coated at a coverage of 56 mg/m$^2$ on each side. Thus, another photographic material of this invention was obtained.

Evaluation of Color Contamination

GRENEX ORTHOSCREEN HR-4 (products of Fuji Photo Film Co., Ltd.) was brought into contact with both sides of the photographic material by the use of cassette, and subjected to X-ray sensitometry. The adjustment of an exposure was achieved by changing the distance between the X-ray tube and the cassette. After the exposure, the photographic processing was carried out using the following developer and fixer in the autodeveloping machine. Thereupon, the extent of color contamination was evaluated by visual observation of Dmin.

O: no problem in practical use.

X: some problem in practical use.

| Processing Condition: | | |
|---|---|---|
| Development | 35° C. | 9.5 sec. |
| Fixation | 31° C. | 10 sec. |
| Washing | 15° C. | 6 sec. |
| Squeeze | | 6 sec. |
| Drying | 50° C. | 12 sec |
| (Dry to Dry processing time: 45 sec.) | | |

| Composition of Developer: | |
|---|---|
| Potassium hydroxide | 29 g |
| Potassium sulfite | 44.2 g |
| Sodium hydrogen carbonate | 7.5 g |
| Boric acid | 1.0 g |
| Diethylene glycol | 12 g |
| Ethylenediaminetetraacetic acid | 1.7 g |
| 5-Methylbenzotriazole | 0.06 g |
| Hydroquinone | 25 g |
| Glacial acetic acid | 18 g |

-continued

| | |
|---|---|
| Triethylene glycol | 12 g |
| 5-Nitroindazole | 0.25 g |
| 1-Phenyl-3-pyrazolidone | 2.8 g |
| Glutaraldehyde (50 wt/wt %) | 9.86 g |
| Sodium metabisulfite | 12.6 g |
| Potassium bromide | 3.7 g |
| Water to make | 1.0 l |
| Composition of Fixer: | |
| Ammonium thiosulfate (70 wt/vol %) | 200 ml |
| Disodium ethylenediaminetetraacetate dihydrate | 0.02 g |
| Sodium sulfite | 15 g |
| Boric acid | 10 g |
| Sodium hydroxide | 6.7 g |
| Glacial acetic acid | 15 g |
| Aluminum sulfate | 10 g |
| Sulfuric acid (36N) | 3.9 g |
| Water to make | 1 l |
| (The pH was adjusted to 4.25) | |

<Detection probability with Sensor>

Ten sheets of each sample were inserted one after another into the film insertion inlet of an auto-developing machine, and examined as to whether the insertion of each sheet was detected or not.

This auto-developing machine had a pair of infrared-ray emission and reception elements (See FIG. 1 and FIG. 2, respectively) on the inside of the film insertion inlet, and was designed so as to recognize the insertion of a sample sheet through adequate shut-off of infrared rays by the inserted sample sheet, and thereby so as to make the conveyer rollers start to revolve, resulting in conveyance of the sample sheet (film) to the developing tank.

<Fixability upon 25% Reduction in Fixer Replenishment>

The running processing was carried out under another condition so that the foregoing fixer was replenished in an amount reduced to ¾ the full amount, and a level of fixation was evaluated.

O: no problem in practical use.

X: poor fixation (inadequate for practical use).

TABLE 3

| Sample | *Dye (mg/m²) | Detection Probability** | Color Contamination | Fixability*** |
|---|---|---|---|---|
| 9 (Comparison) | — | 0 | ○ | ○ |
| 10 (Invention) | 1 (20) | 10 | ○ | ○ |
| 11 (Invention) | 3 (30) | 10 | ○ | ○ |
| 12 (Invention) | 6 (30) | 10 | ○ | ○ |
| 13 (Comparison) | A (100) | 3 | ○ | ○ |
| 14 (Comparison) | B (100) | 3 | ○ | ○ |
| 15 (Comparison) | C (7.5) | 10 | X | X |
| 16 (Comparison) | (light scattering grains) | 7 | ○ | X |

*Dye compound of this invention or Dye for comparison contained in the dye layer for detection with a sensor (coverage per one side).

**by means of a sensor, expressed in terms of the number of detected sheets in 10 sheets.

***in the case of 25% reduction in replenishment of the fixer.

In Sample 15, the dye layer was prepared in a similar manner as in JP-A-62-299959. Specifically, chemically unripened silver iodobromide emulsion grains having an average grain size of 0.19 μm (Ag content: 0.27 g/m²) and Dye C for comparison (7.5 mg/m²) were mixed in advance, and then added to a coating composition for the dye layer. The resulting coating composition was coated.

Dye C for Comparison:

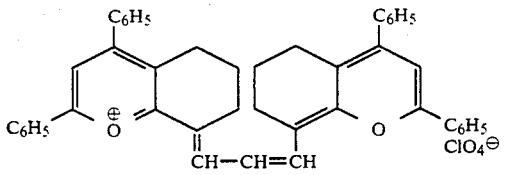

In sample 16, light-scattering grains were incorporated in accordance with JP-A-63-131135. (More specifically, the chemically unripened silver iodobromide emulsion having an average grain size of 0.72 μm was coated at a coverage of 0.22 g/m²).

As can be seen from the data in Table 3, the samples of this invention were excellent in detection probability with a sensor and in fixability, and free from color contamination, that is, satisfied all the requirements.

EXAMPLE 3

Another sample was prepared in the same manner as Sample 12 in Example 2, except that a mixture of equal weights of Compounds 1 and 2 of this invention was used in the place of Compound 6, and tested in accordance with the same processes as in Example 2. As a result of this test, analogously with other dye compounds of this invention, this sample also has proved to give full satisfaction in respects of detection probability with a sensor, color contamination and fixability.

While the invention has been described in detail and with reference to specific embodiments thereof, it will be apparent to one skilled in the art that various changes and modifications can be made therein without departing from the spirit and scope thereof.

What is claimed is:

1. A silver halide photographic light-sensitive material which contains a tricarbocyanine dye in at least one hydrophilic colloid layer, in an amount ranging from 0.1 to 1,000 mg/m², said dye having at least two acidic groups, wherein said dye in the at least one hydrophilic colloid layer has an absorption maximum within the range of 900 nm to 1,500 nm, and said absorption maximum of the dye in the at least one hydrophilic colloid layer is higher by at least 50 nm in comparison with the absorption maximum of the dye in an aqueous solution, wherein said dye is represented by formula (II):

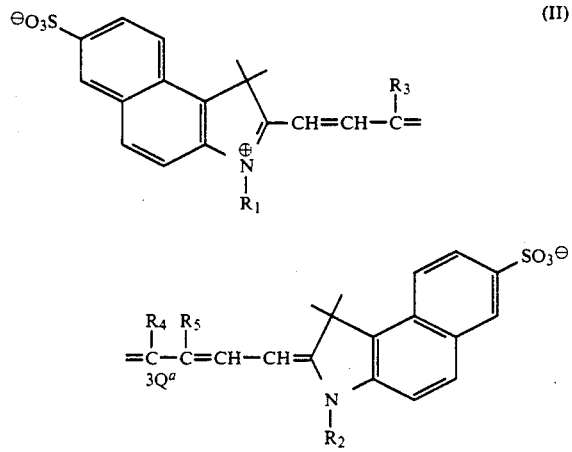

(II)

wherein $R_1$ and $R_2$ each represents a 3-sulfopropyl or 3-sulfobutyl group; $R_3$ and $R_5$ are both hydrogen atoms, or $R_3$ and $R_5$ in combination represent atoms necessary to complete a 5-membered ring; $R_4$ represents a hydrogen atom or a methyl or methoxy group; and Q represents an alkali metal, ammonium, or organic ammonium.

2. The silver halide photographic light-sensitive material as claimed in claim 1, wherein said silver halide photographic light-sensitive material is used for the formation of black-and-white images and has a silver coverage of 5 g/m² or less.

3. The silver halide photographic light-sensitive material as claimed in claim 1, wherein said 5-membered ring completed by combining $R_3$ with $R_5$ is selected from the group consisting of an indene ring and a cyclopentene ring.

4. The silver halide photographic light-sensitive material as claimed in claim 1, wherein the 5-membered ring is a cyclopentene ring.

5. The silver halide photographic light-sensitive material as claimed in claim 1, wherein the tricarbocyanine dye is present in an amount ranging from 1 to 800 mg/m².

6. The silver halide photographic light-sensitive material as claimed in claim 1, wherein one of the at least one hydrophilic colloid layers is a backing layer.

7. The silver halide photographic light-sensitive material as claimed in claim 1, wherein said aqueous solution consists essentially of water and said dye.

* * * * *